US006052332A

United States Patent [19]

Obara

[11] Patent Number: 6,052,332

[45] Date of Patent: Apr. 18, 2000

[54] COUNTERMEASURE FLEXIBLE LINE ARRAY

[75] Inventor: Robert J. Obara, Portsmouth, R.I.

[73] Assignee: The United States of America as represented by the Secretary of the Navy, Washington, D.C.

[21] Appl. No.: 09/152,472

[22] Filed: Sep. 9, 1998

[51] Int. Cl.[7] ..... H04K 3/00

[52] U.S. Cl. ..... 367/1

[58] Field of Search ..... 367/1, 4, 137, 367/165; 434/6, 9, 10; 441/12, 24

[56] References Cited

U.S. PATENT DOCUMENTS

| | | | |
|---|---|---|---|
| 3,921,120 | 11/1975 | Widenhofer | 367/4 |
| 4,631,709 | 12/1986 | Bender et al. | 367/4 |
| 4,725,988 | 2/1988 | Secretan | 367/4 |
| 4,777,627 | 10/1988 | Congdon | 367/3 |
| 5,144,587 | 9/1992 | Mason | 367/1 |
| 5,277,117 | 1/1994 | Bender et al. | 102/402 |

*Primary Examiner*—Daniel T. Pihulic

*Attorney, Agent, or Firm*—Michael J. McGowan; Robert W. Gauthier; Prithvi C. Lall

[57] ABSTRACT

A countermeasure buoy for use in an underwater environment includes a main body portion, a propulsion portion, a hull section, and an acoustical array. The main body portion includes a first end and a second end longitudinally opposed from the first end. The propulsion portion includes a main body end connected to the first end of the main body portion and a propelling end opposite the main body end. The hull section includes a rearward end connected to the second end of the main body portion and an open end opposite to the rearward end. The acoustical array is housed within said hull section and includes a base end connected to an interior of the hull section and a free terminal end opposite to the base end. A cap member is removably attached to the open end of said hull section and a vertical alignment of the propulsion portion, the main body portion and the hull portion enables gravitational displacement of the cap member and release of the acoustical array from the hull section.

19 Claims, 2 Drawing Sheets

COUNTERMEASURE FLEXIBLE LINE ARRAY

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention generally relates to a countermeasure flexible line array. More particularly, the invention relates to a countermeasure flexible line array and deployment of the countermeasure flexible line array from a countermeasure housing device.

(2) Description of the Prior Art

Stationary countermeasures are known in the art. All known stationary countermeasures employ a rigid vertical line array of projectors to provide omnidirectional coverage in a horizontal plane (parallel to the water's surface). The following patents, for example, disclose the placement of serially connected transducers, sonobuoys and the like in a vertical water column, but do not disclose an entire system for deploying flexible countermeasure arrays in a vertical alignment as disclosed in the present invention.

U.S. Pat. No. 3,921,120 to Widenhofer;

U.S. Pat. No. 4,631,709 to Bender et al.;

U.S. Pat. No. 4,725,988 to Secretan;

U.S. Pat. No. 4,777,627 to Congdon;

U.S. Pat. No. 5,144,587 to Mason; and

U.S. Pat. No. 5,277,117 to Bender et al.

Specifically, the patent to Widenhofer discloses a sonobuoy deployment system in which a negatively buoyant casing is dropped into the water. A float 30 is deployed from the casing. Tethered to the float are a plurality of sonobuoy components 22, 24 deployed vertically in the water.

The patent to Bender et al. discloses a sonobuoy designed to float on, and transmit from, the water's surface. Once deployed, the transducer 24 is released into the water and is tethered to housing 12 via cable 26.

Secretan discloses a system for deploying an array of transducers 36 vertically in the water. The transducers are stored within a housing 10 deployed vertically in the water. The transducers 36 are tethered to one another via cables 38, 40.

Congdon discloses an extendible sonobuoy apparatus in which a canister 36 is maintained in a vertical orientation in the water (FIG. 4). Acoustic components are stacked and released vertically from the canister 36. A nose weight 40 is used to sink the components and maintain verticality.

Mason discloses a submarine-deployed underwater vehicle 20 with a propulsion system 22 mounted in its nose. A curtain 30 of cables/mesh is stored within underwater vehicle 20 and deployed from the aft portion thereof to trail behind the underwater vehicle. Echo repeaters 40 can be included along the curtain's cables.

Bender et al. disclose a water craft that carries an acoustic transmitter 40 that can be lowered vertically in the water.

It should be understood that the present invention would in fact enhance the functionality of the above patents by providing a more volumetrically efficient, less costly, and higher reliability flexible countermeasure projector array which is stored in a countermeasure buoy prior to deployment.

SUMMARY OF THE INVENTION

Therefore, it is an object of this invention to provide a countermeasure buoy for deploying a flexible line array.

Another object of this invention is to provide a countermeasure buoy for deploying a flexible line array in which the flexible line array is stored in a cage portion of the countermeasure buoy.

Still another object of this invention is to provide a countermeasure buoy for deploying a flexible line array in which the countermeasure buoy vertically hovers while deploying the vertical line array.

A still further object of the invention is to provide a countermeasure buoy for deploying a flexible line array in which the countermeasure array is maintained in a vertical alignment during descent of the countermeasure buoy.

Yet another object of this invention is to provide a countermeasure buoy for deploying a flexible line array which is simple to manufacture and easy to use.

The inventive concept utilizes a flexible line array that, prior to acoustic operation, is packaged in smaller volume within a protective cage and later deployed for operation. In accordance with one aspect of this invention, there is provided a countermeasure buoy for use in an underwater environment which includes a main body portion, a propulsion portion, a hull section, and an acoustical array. The main body portion includes a first end and a second end longitudinally opposed from the first end. The propulsion portion includes a main body end connected to the first end of the main body portion and a propelling end opposite the main body end. The hull section includes a main body end connected to the second end of the main body portion and an open end opposite to the first end. The acoustical array is housed within said hull section and includes a base end connected to an interior of the hull section and a free terminal end opposite to the base end. A cap member is removably attached to the open end of said hull section and a vertical alignment of the propulsion portion, the main body portion and the hull portion enables gravitational displacement of the cap member and release of the acoustical array from the hull section.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

Figure 1:
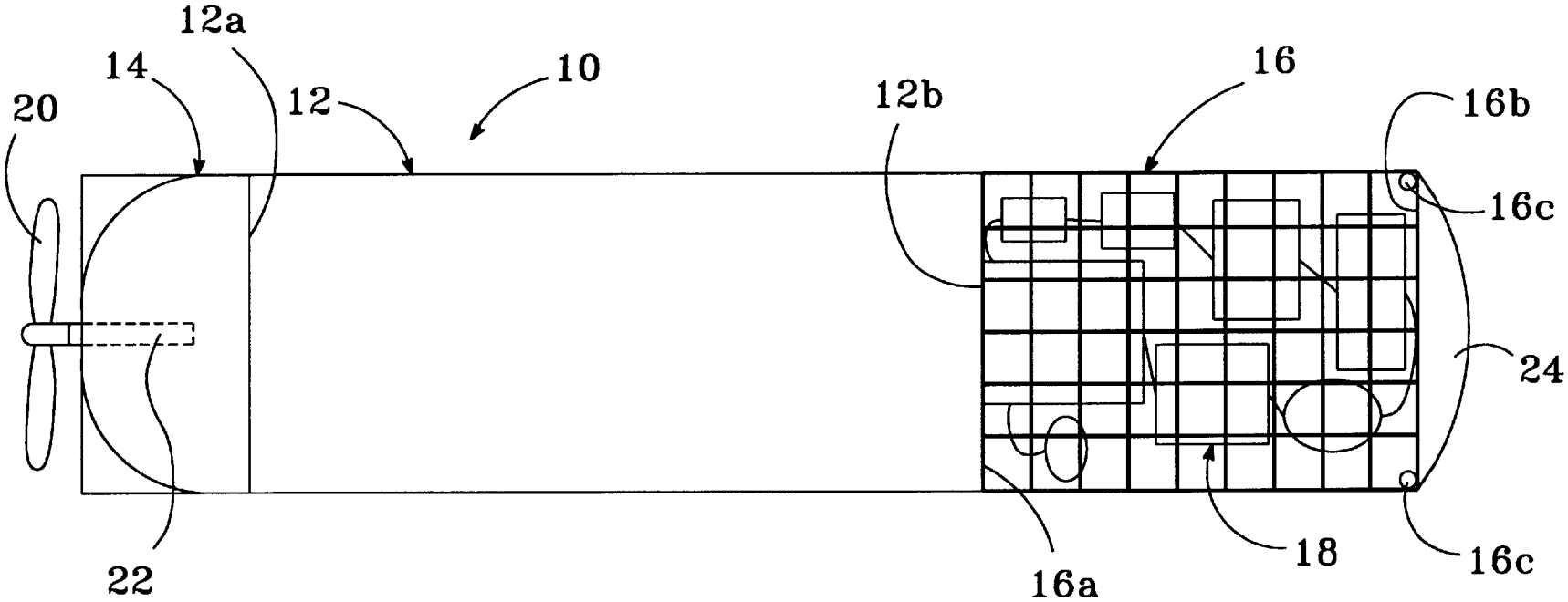
FIG. 1 is a side view of a countermeasure buoy housing a countermeasure array according to a first preferred embodiment of the present invention.

In general, the present invention is directed to a countermeasure acoustic communication buoy generally shown at 10 in FIG. 1. The countermeasure acoustic communication buoy 10 is intended to provide housing for and deployment of a countermeasure array generally shown at 18, the countermeasure buoy 10 being more volumetrically efficient, less costly, and more reliable than previously known.

Referring specifically to FIG. 1, the countermeasure acoustic communication buoy 10 (hereinafter referred to as the countermeasure buoy 10), includes three primary components. Specifically, the countermeasure buoy 10 is generally of a cylindrical shape and includes a main body portion 12 longitudinally flanked by a propulsion portion 14 and a flow-through cage portion 16. In other words, the propulsion portion 14 is formed at an opposite end of the main body portion 12 from the flow-through cage portion 16. In order to provide effective acoustic energy transmissions, the cap portion is very nearly acoustically transparent. Although the countermeasure buoy 10, including its component parts of the main body portion 12, the propulsion portion 14, and the flow-through cage portion 16 are described and shown as cylindrical, any suitable shape may be utilized.

The main body portion 12 of the countermeasure buoy 10 will house all necessary electrical and other related components required to transmit acoustic energy into a surrounding medium and control the operations of the countermeasure buoy 10, including actuation of the propulsion portion 14 and deployment of the countermeasure array 18 from the flow-through cage 16.

The propulsion portion 14 is integrally fixed to one end 12*a* of the main body portion 12 by any suitable means such as welding, snap fit, bolts, or any other mechanical connection. By this description, an integral connection is intended to include a one-piece assembly or removably connected components. The propulsion portion 14 includes a propeller member 20 and a shaft 22 connected to the propeller member 20 such that the shaft 22 extends into an interior of the propulsion portion 14 and the propeller member 20 is exterior to the propulsion portion 14. By the arrangement shown, the shaft 22 of the propeller 20 is caused to rotate by internal mechanics and control of the main body portion 12 using known components. Accordingly, the exact components used to rotate the shaft 22 of the propeller 20 will be known by one of ordinary skill in the art and will not be further described herein. The general purpose of the propulsion portion 14 is to selectively propel the countermeasure buoy 10 in an upward or downward direction against forces exerted on the countermeasure buoy 10 under conditions of deploying the countermeasure array 18.

The remaining feature of the countermeasure buoy 10 is the flow-through cage portion 16. The flow-through cage portion 16 is as its name describes, and is formed of a wire mesh or other suitable material which will enable water and also acoustic energy to pass in a substantially unobstructed manner therethrough and will adequately resist forces during launch of the buoy 10. As shown in each of the figures, the flow-through cage portion 16 houses the countermeasure array 18.

Referring more specifically to the structure of the flow-through cage 16, the first end 16*a* of the cage portion 16 is fixed to the main body portion 12 of the countermeasure buoy 10. Similar to the description in connection with attachment of the propulsion portion 14 to the main body portion 12, there are several options available, and none are intended to limit the scope of the invention. For example, the flow-through cage portion 16 may be integrally formed with the main body portion 12 as either a one-piece construction or removable portion by welding, friction fit, bolts, and the like. A second end 16*b* of the flow-through cage 16 includes a protective cap 24. The protective cap 24 is intended to be removed and is, therefore, attached to the second end 16*b* of the flow-through cage 16 by a friction fit.

By the present invention, having a structure as primarily described in connection with FIG. 1, the flexible line array 18, prior to acoustic operation, is packaged into a smaller volume than previously known within the protective flow-through cage 16 and may be later deployed for operation.

Figure 2C:
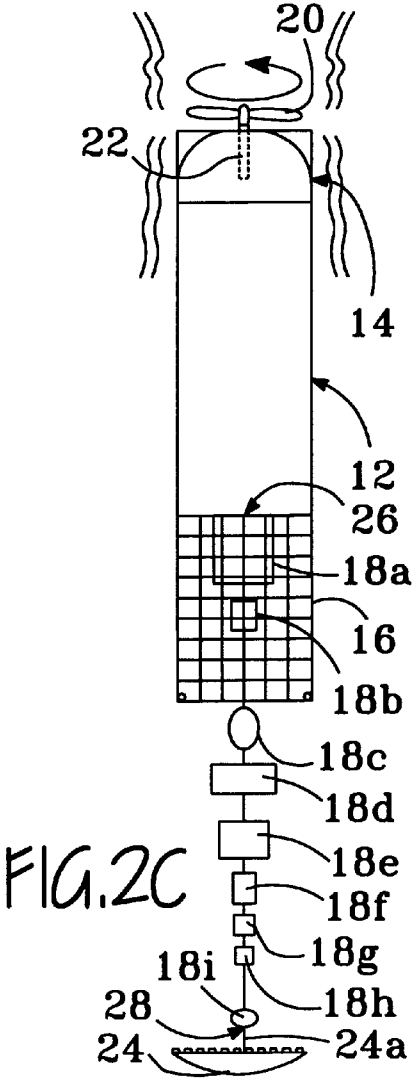
FIG. 2C is a side view of the countermeasure buoy housing the countermeasure array of FIG. 1 and deploying the countermeasure array in a later stage of deployment.
Figure 2B:
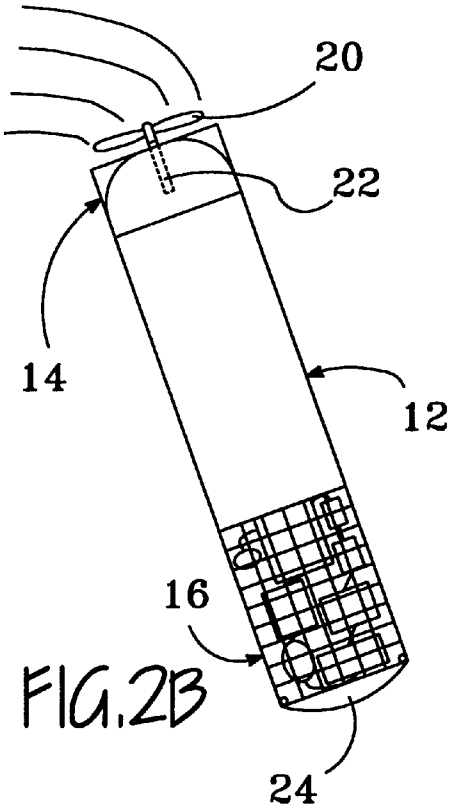
FIG. 2B is a side view of the countermeasure buoy housing the countermeasure array of FIG. 1 in a further stage of deployment of the countermeasure array.
Figure 2A:
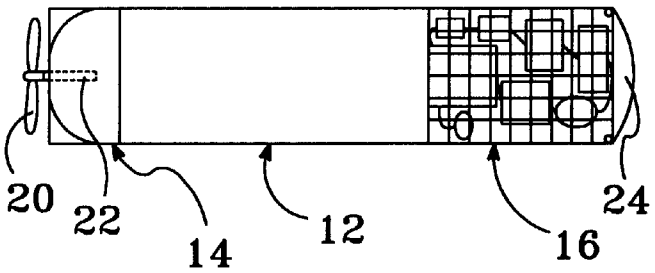
FIG. 2A is a side view of the countermeasure buoy housing the countermeasure array of FIG. 1 in an initial stage of deployment of the countermeasure array.

Operation of the countermeasure device 10 and deployment of the flexible countermeasure array 18 is primarily shown in FIGS. 2A through 2C and operates as follows. Prior to launch of the countermeasure buoy 10, the flexible line array 18 is compactly packaged into the protective flow-through cage 16 as shown in FIG. 2A. As shown in FIG. 2C, the countermeasure array 18 is attached to the first end 16*a* of the flow-through cage portion 16 at a base end 26 thereof. A terminal end 28 of the countermeasure array 18 is free from connection to the countermeasure buoy 10. As will be understood, the protective cage 16 is capable of releasing the protective cap 24 during the launch process. As an alternative, the protective cap 24 may be additionally physically attached to the countermeasure array 18 at the terminal end 28 thereof, indicated by attachment 24*a*. In the event that the protective cap 24 is additionally fit to the terminal end 28 of the countermeasure array 18, it will assist in the vertical orienting of the countermeasure array 18 upon deployment thereof from the flow-through cage portion 16. After launch, the countermeasure buoy 10 slows as shown in FIG. 2B and rotates to a vertical position as shown in FIG. 2C. When the countermeasure buoy 10 reaches a vertical alignment in which the propulsion portion 14 is oriented toward a surface of the water (not shown), the propeller 20 of the propulsion portion 14 is actuated thereby counteracting the descent of the countermeasure buoy 10.

Additionally, when the countermeasure buoy 10 is hovering in the vertical position of FIG. 2C, the protective cap 24 "falls" off due to the effects of gravity and the flexible countermeasure array 18 is thus vertically deployed. Alternatively, cage 16 may incorporate a pressure sensitive release mechanism 16*c* to release cap 24 at a predetermined depth, such release mechanisms being well known in the art of underwater buoys. Lower frequency countermeasure projectors 18*a*, 18*b*, of the countermeasure array 18 can be located within the protective cage 16, with increasingly higher frequency projectors 18*c*, 18*d*, 18*e*, 18*f*, 18*g*, 18*h* and 18*i* (for example) are located increasingly lower in a vertical direction along the array 18 outside the cage 16 as shown in FIG. 2C. The protective cap 24 acts as a drag reducer during the launch, and when attached to array 18 can act as a drogue to keep the flexible countermeasure array 18 vertical during the hovering process.

By utilizing the flexible line array projector concept, the countermeasure buoy 10, which is restricted in volume allocated by the launcher system, has several advantages including: a) requiring less volume allocation to the projectors of the flexible countermeasure array 18 prior to launch, and thus enabling more volume for other subsystems and increasing buoyancy; (b) eliminating a low reliability and excessively heavy sabot over the projector array 18 in order for the array to survive the launch; (c) providing better beam pattern coverage with the projectors of the array 18 in the vertical plane; (d) providing better thermal cooling during acoustic operation of the projectors of the flexible countermeasure array 18; and (e) lowering production cost of the countermeasure buoy 10 as a whole.

By the present invention, countermeasure arrays 18, and more specifically, flexible countermeasure arrays 18, are deployed in a more efficient manner than previously achieved in the art.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. A countermeasure buoy for use in an underwater environment comprising:

a main body portion having a first end and a second end longitudinally opposed from the first end;

a propulsion portion including a main body end connected to the first end of said main body portion and a propelling end longitudinally opposed from the main body end;

a hull section including a rearward end connected to the second end of said main body portion and an open end longitudinally opposed from the rearward end;

an acoustical array housed within said hull section, the acoustical array including a base end connected to an interior of said hull section and a free terminal end opposite to the base end; and a cap member removably attached to the open end of said hull section, a vertical alignment of said propulsion portion, said main body portion and said hull portion enabling gravitational displacement of said cap member and release of said acoustical array.

2. The countermeasure buoy according to claim 1 wherein said propulsion portion counters a descent of said countermeasure buoy during release of said acoustical array.

3. The countermeasure buoy according to claim 1 wherein each of said main body portion, said propulsion portion, and said hull portion are substantially cylindrical in shape.

4. The countermeasure buoy according to claim 1 wherein said propulsion portion and said hull portion are integrally connected to said main body portion.

5. The countermeasure buoy according to claim 1 wherein said propulsion portion includes a shaft rotatably mounted therein and a propellor fixed to an exposed end of said shaft.

6. The countermeasure buoy according to claim 1 wherein said hull section is formed of a flow-through material.

7. The countermeasure buoy according to claim 6 wherein said flow-through material is a wire mesh.

8. The countermeasure buoy according to claim 6 wherein said flow-through material is a plastic mesh.

9. The countermeasure buoy according to claim 1 wherein said acoustical array is a flexible countermeasure array.

10. The countermeasure buoy according to claim 9 wherein said flexible countermeasure array includes a plurality of projectors thereon.

11. The countermeasure buoy according to claim 1 wherein said cap is permanently fixed to the terminal end of said acoustical array.

12. The countermeasure buoy according to claim 11 wherein fixing of said cap to the terminal end of said acoustical array provides ballast to said acoustical array to maintain vertical alignment of the acoustical array upon its release.

13. The countermeasure buoy of claim 1 wherein the hull section is formed of material suitable to allow the passage of acoustic energy.

14. The countermeasure buoy of claim 1 wherein the hull section further comprises a pressure sensitive release mechanism to releasably attach the cap to the hull section, the release mechanism being activated at a predetermined depth to release the cap allowing for the gravitational displacement of the cap.

15. A method for deploying a line array of acoustic projectors in an underwater environment comprising the steps of:

fixing a first end of the line array to an inner end of a hull section of a countermeasure buoy;

packing the line array in the hull section through an open end of the hull section removed from the inner end;

providing a removable cap over the open end of the hull section to contain the line array within the hull section;

dispensing the countermeasure buoy in the underwater environment;

allowing the countermeasure buoy to slow and orient toward vertical, the open end of the hull section vertically below the inner end;

maintaining the countermeasure in a vertical position;

releasing the cap from the open end; and deploying the line array from within the hull section, the line array extending vertically from the first end.

16. The method according to claim 15 wherein the maintaining step further comprises providing a propulsion portion attached to the buoy, the propulsion portion countering a descent of said countermeasure buoy during release of said line array.

17. The method of claim 15 further comprising the step of attaching the cap to a second end of the line array remote from the first end prior to the step of providing the cap over the open end of the hull section.

18. The method of claim 15 wherein:

the cap provision step further comprises securing the cap to the hull section by means of a pressure sensitive release mechanism; and the releasing step further comprises activation of the pressure sensitive release mechanism at a predetermined depth.

19. The method of claim 17 wherein the deploying step further comprises the cap exerting a pulling force on the line array.

* * * * *